US008905037B2

(12) United States Patent
Lipowicz et al.

(10) Patent No.: US 8,905,037 B2
(45) Date of Patent: Dec. 9, 2014

(54) ENHANCED SUBJECTIVE ACTIVATED CARBON CIGARETTE

(75) Inventors: Peter Lipowicz, Midlothian, VA (US); Firooz Rasouli, Midlothian, VA (US)

(73) Assignee: Philip Morris Inc., Richmond, VA (US)

( * ) Notice: Subject to any disclaimer, the term of this patent is extended or adjusted under 35 U.S.C. 154(b) by 739 days.

(21) Appl. No.: 12/579,596

(22) Filed: Oct. 15, 2009

(65) Prior Publication Data

US 2011/0088704 A1 Apr. 21, 2011

(51) Int. Cl.

| | |
|---|---|
| ***A24C 5/47*** | (2006.01) |
| ***A24C 1/32*** | (2006.01) |
| ***A24D 3/04*** | (2006.01) |
| ***A24D 1/00*** | (2006.01) |

(52) U.S. Cl.

CPC *A24D 1/00* (2013.01); *A24D 3/041* (2013.01); *A24D 3/04* (2013.01)

USPC ..... 131/88; 131/331; 131/361; 131/360; 131/340; 131/335

(58) Field of Classification Search

None

See application file for complete search history.

(56) References Cited

U.S. PATENT DOCUMENTS

| | | | |
|---|---|---|---|
| 2,592,553 | A | 4/1952 | Frankenburg et al. |
| 2,592,554 | A | 4/1952 | Frankenburg |
| 2,598,680 | A | 6/1952 | Frankenburg |
| 2,769,734 | A | 11/1956 | Bandel |
| 2,954,783 | A | 1/1960 | Lebert |
| 2,954,772 | A | 10/1960 | Lebert |
| 2,954,778 | A | 10/1960 | Lebert |
| 2,954,786 | A | 10/1960 | Lebert |
| 3,098,492 | A | 7/1963 | Wurzburg et al. |
| 3,219,040 | A | 11/1965 | Kim |
| 3,236,244 | A | 2/1966 | Irby, Jr. et al. |
| 3,255,760 | A | 6/1966 | Selke |
| 3,283,762 | A | 11/1966 | Kissel |
| 3,318,312 | A | 5/1967 | Curtis, Jr. |
| 3,356,094 | A | 12/1967 | Ellis et al. |
| 3,395,713 | A | 8/1968 | Ent-Keller |

(Continued)

FOREIGN PATENT DOCUMENTS

| | | | |
|---|---|---|---|
| BE | 679657 | A | 10/1966 |
| BE | 1000454 | A4 | 12/1988 |

(Continued)

OTHER PUBLICATIONS

International Search Report and Written Opinion mailed Feb. 10, 2011 for PCT/EP2010/006255.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A smoking article having a tobacco rod and a filter attached to the tobacco rod, which filters the first puff differently than subsequent puffs. The tobacco rod includes an inner rod of tobacco material having an impervious outer wrap and an impervious cap at an upstream end thereof and an outer rod of tobacco material, wherein the inner rod of tobacco material is concentrically positioned with respect to the outer rod of tobacco material. The filter includes an outer cellulose acetate filter and an inner activated carbon filter, wherein the inner activated carbon filter is concentrically positioned with respect to the outer cellulose acetate filter.

19 Claims, 1 Drawing Sheet

(56) References Cited

U.S. PATENT DOCUMENTS

| | | | | |
|---|---|---|---|---|
| 3,457,927 | A | 7/1969 | Siragusa | |
| 3,496,945 | A | 2/1970 | Tomkin | |
| 3,581,748 | A | 6/1971 | Cameron | |
| 3,637,447 | A | 1/1972 | Berger et al. | |
| 3,648,712 | A | 3/1972 | Patterson | |
| 3,685,522 | A | 8/1972 | Kleinhans | |
| 3,738,375 | A | 6/1973 | Doumas | |
| 3,756,249 | A | 9/1973 | Selke et al. | |
| 3,759,270 | A | 9/1973 | Wright | |
| 3,860,011 | A | 1/1975 | Norman | |
| 3,931,824 | A | 1/1976 | Miano et al. | |
| 3,968,804 | A | 7/1976 | Kelly et al. | |
| 3,986,515 | A | 10/1976 | Egri | |
| 4,016,887 | A | 4/1977 | Uroshevich | |
| 4,022,222 | A | 5/1977 | Berger | |
| 4,091,821 | A | 5/1978 | Scorzo | |
| 4,119,105 | A | 10/1978 | Owens, Jr. | |
| 4,120,310 | A | 10/1978 | Lee et al. | |
| 4,135,523 | A | 1/1979 | Luke et al. | |
| 4,182,349 | A | 1/1980 | Selke | |
| 4,186,756 | A | 2/1980 | Takemoto et al. | |
| 4,197,863 | A | 4/1980 | Clayton et al. | |
| 4,256,122 | A | 3/1981 | Johnson | |
| 4,256,126 | A | 3/1981 | Seligman et al. | |
| 4,273,141 | A | 6/1981 | Jan Van Tilburg | |
| 4,292,983 | A | 10/1981 | Mensik | |
| 4,340,072 | A | 7/1982 | Bolt et al. | |
| 4,341,228 | A | 7/1982 | Keritsis et al. | |
| 4,357,950 | A | 11/1982 | Berger | |
| 4,380,241 | A | 4/1983 | Horsewell | |
| 4,386,618 | A | 6/1983 | Cantrell | |
| 4,421,126 | A | 12/1983 | Gellatly | |
| 4,460,001 | A | 7/1984 | Browne et al. | |
| 4,469,112 | A | 9/1984 | Browne et al. | |
| 4,508,525 | A | 4/1985 | Berger | |
| 4,515,170 | A | 5/1985 | Cantrell et al. | |
| 4,542,755 | A | 9/1985 | Selke et al. | |
| 4,564,030 | A | 1/1986 | Jessup et al. | |
| 4,574,820 | A | 3/1986 | Pinkerton et al. | |
| 4,585,015 | A | 4/1986 | Silberstein | |
| 4,622,982 | A | 11/1986 | Gaisch et al. | |
| 4,637,409 | A | 1/1987 | Berger | |
| 4,649,944 | A | 3/1987 | Houck, Jr. et al. | |
| 4,660,579 | A | 4/1987 | Horsewell et al. | |
| 4,677,992 | A | 7/1987 | Bliznak | |
| 4,687,008 | A | 8/1987 | Houck, Jr. et al. | |
| 4,700,726 | A | 10/1987 | Townsend et al. | |
| 4,732,168 | A | 3/1988 | Resce et al. | |
| 4,754,766 | A | 7/1988 | Luke et al. | |
| 4,784,632 | A | 11/1988 | Berger | |
| 4,793,365 | A | 12/1988 | Sensabaugh et al. | |
| 4,867,182 | A | 9/1989 | Roberts et al. | |
| 4,874,004 | A * | 10/1989 | Borowski et al. | 131/364 |
| 4,896,682 | A | 1/1990 | Liew | |
| 4,924,886 | A | 5/1990 | Litzinger | |
| 4,942,887 | A | 7/1990 | Abdelgawad et al. | |
| 4,962,774 | A | 10/1990 | Thomasson et al. | |
| 4,972,853 | A | 11/1990 | Brackmann et al. | |
| 4,972,854 | A | 11/1990 | Kiernan et al. | |
| 4,984,588 | A * | 1/1991 | Stewart, Jr. | 131/364 |
| 5,046,514 | A | 9/1991 | Bolt | |
| 5,050,621 | A | 9/1991 | Creighton et al. | |
| 5,058,608 | A | 10/1991 | Henning et al. | |
| 5,060,676 | A | 10/1991 | Hearn et al. | |
| 5,074,319 | A | 12/1991 | White et al. | |
| 5,099,864 | A | 3/1992 | Young et al. | |
| 5,101,839 | A | 4/1992 | Jakob et al. | |
| 5,105,836 | A | 4/1992 | Gentry et al. | |
| 5,105,838 | A | 4/1992 | White et al. | |
| 5,129,408 | A | 7/1992 | Jakob et al. | |
| 5,178,166 | A | 1/1993 | Newsome et al. | |
| 5,190,061 | A | 3/1993 | Brackmann et al. | |
| 5,203,354 | A | 4/1993 | Hickle | |
| 5,360,023 | A | 11/1994 | Blakley et al. | |
| 5,392,792 | A | 2/1995 | Banerjee et al. | |
| 5,392,793 | A | 2/1995 | Molloy | |
| 5,435,326 | A | 7/1995 | Gentry et al. | |
| 5,439,011 | A | 8/1995 | Schneider | |
| 5,458,107 | A | 10/1995 | Balogh et al. | |
| 5,524,647 | A | 6/1996 | Brackmann | |
| 5,533,530 | A | 7/1996 | Young et al. | |
| 5,568,819 | A | 10/1996 | Gentry et al. | |
| 5,584,306 | A | 12/1996 | Beauman et al. | |
| 5,598,868 | A | 2/1997 | Jakob et al. | |
| 5,666,976 | A | 9/1997 | Adams et al. | |
| 5,690,127 | A | 11/1997 | Chapman et al. | |
| 5,709,227 | A | 1/1998 | Arzonico et al. | |
| 5,715,844 | A | 2/1998 | Young et al. | |
| 5,724,998 | A | 3/1998 | Gellatly et al. | |
| 5,727,571 | A | 3/1998 | Meiring et al. | |
| 5,743,251 | A | 4/1998 | Howell et al. | |
| 5,746,230 | A | 5/1998 | Arterbery et al. | |
| 5,839,449 | A | 11/1998 | Banerjee et al. | |
| 5,954,061 | A | 9/1999 | Cardarelli | |
| 6,089,238 | A | 7/2000 | Schneider et al. | |
| 6,216,706 | B1 | 4/2001 | Kumar et al. | |
| 6,257,242 | B1 | 7/2001 | Stavridis | |
| 6,718,989 | B1 | 4/2004 | Clarke et al. | |
| 6,761,174 | B2 | 7/2004 | Jupe et al. | |
| 6,779,529 | B2 | 8/2004 | Figlar et al. | |
| 6,814,786 | B1 | 11/2004 | Zhuang et al. | |
| 6,823,873 | B2 | 11/2004 | Nichols et al. | |
| 6,883,516 | B2 | 4/2005 | Hindle et al. | |
| 6,883,523 | B2 | 4/2005 | Dante | |
| 6,976,493 | B2 * | 12/2005 | Chapman et al. | 131/365 |
| 2002/0166561 | A1 | 11/2002 | Sinclair | |
| 2002/0166563 | A1 * | 11/2002 | Jupe et al. | 131/331 |
| 2003/0200973 | A1 | 10/2003 | Xue et al. | |
| 2003/0200976 | A1 | 10/2003 | Xue et al. | |
| 2004/0025890 | A1 | 2/2004 | Yen | |
| 2004/0159327 | A1 | 8/2004 | Dante | |
| 2004/0261807 | A1 | 12/2004 | Dube et al. | |
| 2005/0066981 | A1 | 3/2005 | Crooks et al. | |
| 2006/0201524 | A1 | 9/2006 | Zhang et al. | |
| 2007/0181140 | A1 | 8/2007 | Xue et al. | |
| 2007/0186945 | A1 | 8/2007 | Olegario et al. | |
| 2007/0235050 | A1 | 10/2007 | Li et al. | |
| 2007/0261706 | A1 | 11/2007 | Banerjea et al. | |
| 2008/0017204 | A1 | 1/2008 | Braunshteyn et al. | |
| 2008/0047571 | A1 | 2/2008 | Braunshteyn et al. | |
| 2008/0163877 | A1 | 7/2008 | Zhuang et al. | |
| 2008/0216848 | A1 | 9/2008 | Li et al. | |
| 2008/0216851 | A1 | 9/2008 | Olegario et al. | |
| 2011/0048436 | A1 | 3/2011 | Fiebelkorn | |

FOREIGN PATENT DOCUMENTS

| | | | |
|---|---|---|---|
| DE | 3439861 | A1 | 5/1985 |
| EP | 0077123 | A2 | 4/1983 |
| EP | 0212879 | A1 | 3/1987 |
| EP | 0364256 | A1 | 4/1990 |
| EP | 0471 581 | A1 | 2/1992 |
| EP | 0482 872 | A1 | 4/1992 |
| EP | 0568107 | A | 11/1993 |
| EP | 0481596 | B1 | 1/1994 |
| EP | 0608047 | A2 | 7/1994 |
| FR | 2481581 | | 11/1981 |
| GB | 1058342 | A | 2/1967 |
| GB | 1228747 | | 4/1971 |
| GB | 1256154 | | 12/1971 |
| GB | 1397936 | A | 6/1975 |
| GB | 1436636 | A | 5/1976 |
| GB | 2100573 | A | 1/1983 |
| GB | 2149287 | A | 6/1985 |
| GB | 2177890 | A | 2/1987 |
| WO | WO 90/09741 | A | 9/1990 |
| WO | WO 99/26495 | A | 6/1999 |
| WO | WO00/00047 | | 1/2000 |
| WO | WO 02/03819 | A | 1/2002 |
| WO | WO 2006/070289 | A | 7/2006 |
| WO | WO2006/082529 | A | 8/2006 |
| WO | WO2007/093757 | A1 | 8/2007 |
| WO | WO2007/110650 | A1 | 10/2007 |
| WO | WO 2008/059377 | A2 | 5/2008 |

(56) References Cited

FOREIGN PATENT DOCUMENTS

OTHER PUBLICATIONS

International Search Report and Written Opinion dated Mar. 17, 2008 for PCT/IB2006/004209.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/001144 dated Jul. 7, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion issued Jan. 25, 2008 for PCT/IB2007/002869.
International Preliminary Report on Patentability issued Jan. 13, 2009 for PCT/IB2007/002910.
International Preliminary Report of Patentability issued Jul. 10, 2008 for PCT/IB2006/004209.
International Search Report and Written Opinion issued Sep. 19, 2008 for PCT/IB2007/004503.
International Preliminary Report on Patentability issued Jul. 9, 2009 for PCT/IB2007/004503.
International Preliminary Report on Patentability issued Jul. 10, 2008 for PCT/IB2006/004202.
Written Opinion dated Aug. 5, 2004 for International Application No. PCT/US04/04530.
International Search Report dated Aug. 5, 2004 for PCT/US04/04530.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Oct. 19, 2007 for PCT/IB2006/004202.
International Preliminary Report on Patentability issued Apr. 17, 2012 for PCT/EP2010/006255.

* cited by examiner

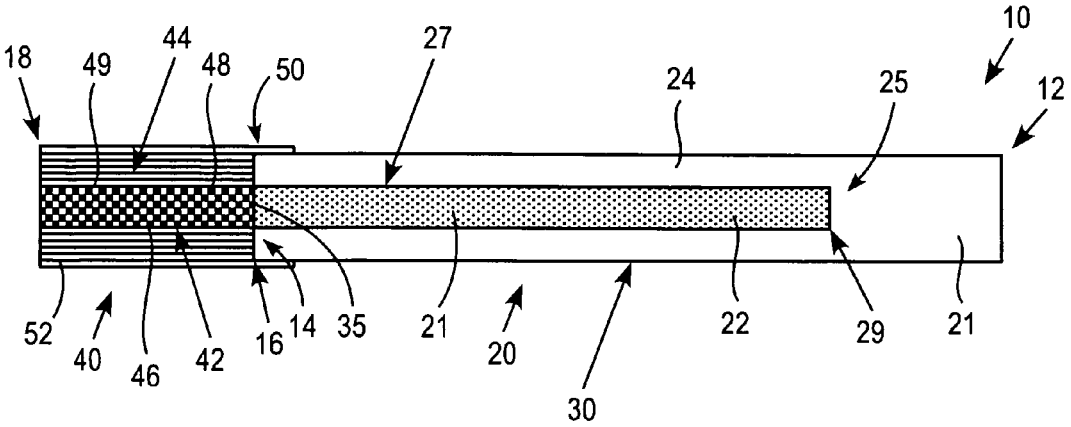
10
12
18
49
44
48
50
27
24
25
52
40
46
42
16
14
35
21
20
30
22
29
21

ENHANCED SUBJECTIVE ACTIVATED CARBON CIGARETTE

WORKING ENVIRONMENT

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally about 7.0 and 10.0 millimeters in diameter and 60 millimeters and 125 millimeters in length.

Typically, the filter includes a plug of cellulose acetate tow attached to the tobacco rod by tipping paper. Ventilation of mainstream smoke can be achieved with a row or rows of perforations about a location along the filter. In addition, activated carbon can be added to the filter to remove many gas phase components from the smoke. Unfortunately, American smokers perceive a taste deficit with carbon-filter cigarettes.

BRIEF DESCRIPTION OF THE DRAWINGS

FIG. 1 is a cross sectional view of an enhanced subjective activated carbon smoking article in accordance with one embodiment.

DETAILED DESCRIPTION

Described herein is a smoking article that provides an acceptable flavor during the first puff or puffs and thereafter directs the mainstream smoke through a carbonaceous and/or highly ventilated filter.

In accordance with one embodiment, a smoking article comprises: a tobacco rod including: an outer tobacco rod and an inner rod of tobacco material having an impervious outer wrapper and an impervious cap at an upstream end thereof; an inner rod of tobacco material is concentrically positioned with respect to the outer rod of tobacco material. A filter is attached to the tobacco rod, and includes an outer filter; and an inner filter that is concentrically positioned with respect to the outer filter.

In accordance with another embodiment, a smoking article includes a tobacco rod comprising: an inner rod of tobacco material having an impervious outer wrap and an impervious cap at an upstream end thereof; and an outer rod of tobacco material, wherein the inner rod of tobacco material is concentrically positioned with respect to the outer rod of tobacco material; and a filter attached to the tobacco rod, the filter comprising: an outer cellulose acetate filter; and an inner activated carbon filter, wherein the inner activated carbon filter is concentrically positioned with respect to the outer cellulose acetate filter.

Referring to FIG. 1, a smoking article 10 in the form of a cigarette is shown that filters the first puff differently than subsequent puffs, such that there is minimal carbon taste in the first puff and improved subjectives for all puffs thereafter. In accordance with one embodiment, the smoking article 10 delivers a mainstream smoke at the initiation of smoking that at least in substantial part, has not contacted an activated carbon filter 42 associated with the filter 40 of the smoking article 10, and is therefore without the taste deficits commonly associated with carbon-filter cigarettes.

As shown in FIG. 1, the smoking article 10 includes a generally cylindrical rod 20 of smokable material 21 contained in a circumscribing outer wrapper 30. The cylindrical rod 20 of smokable material 21 is typically referred to as a "tobacco rod" and has a lit end or upstream end 12 and a tipped end 14.

In accordance with one embodiment, the tobacco rod 20 is comprised of an inner rod (or central core) 22 of smokable material 21, and an outer rod (or outer core) 24 of smokable material 21. The inner rod 22 is concentrically positioned with respect to the outer rod 24 (i.e., the outer rod 24 surrounds the inner rod 22). The inner rod 22 extends from the tipped end 14 towards the lit or upstream end 12 for about 75 to 95 percent of the length of the tobacco rod 20. Additionally, the inner rod 22 preferably has an inner diameter of between approximately 2 to 6 millimeters and more preferably approximately 3 to 5 millimeters. Preferably, the upstream end 12 of the tobacco rod 20 is filled with smokable material 21, which will be enough for an initial puff or puffs, and more preferably filled with a smokable material 21 for about 5 to 25 percent of the length of the tobacco rod 20.

In a preferred embodiment, the inner rod (or central core) 22 is comprised of tobacco shreds, which are wrapped in an impervious tobacco sheet 27. Preferably, the inner rod (or central core) 22 has a sealed upstream end 25 and an open downstream end 35. The upstream end 25 of the inner rod 22 is sealed by an impervious end cap 29. Preferably, the end cap 29 includes an impervious tobacco sheet or other suitable material, such as a paper made of natural fibers, which can include tobacco fibers and reconstituted tobacco. In accordance with an embodiment, the impervious tobacco sheet 27 and/or the impervious end cap 29 is a tobacco sheet of reconstituted tobacco. The smolder of the cigarette combusts the end cap 29 of the inner rod (or central core) 22, opening the inner rod 22 to flow. In an embodiment, the outer rod 24 is comprised of tobacco shreds wrapped in an outer wrapper 30. Preferably, the outer wrapper 30 is a porous wrapping material or paper wrapper.

The smoking article 10 also includes a filter 40 adjacent to the tipped end 14 of the tobacco rod 20 such that the filter 40 and tobacco rod 20 are axially aligned in an end-to-end relationship, preferably abutting one another. The filter 40 has a generally cylindrical shape, and the diameter thereof is essentially equal to the diameter of the tobacco rod 20. The ends 16, 18 (i.e., upstream end and downstream end (i.e., mouth end or buccal end) of the filter 40 are open to permit the passage of air and smoke therethrough.

In accordance with a preferred embodiment, the filter 40 is comprised of a central or inner carbon filter 42, which is coaxially or concentrically positioned within an outer filter (or filter shell) 44 of the filter 40. The inner carbon filter 42 has an outer diameter, which is preferably equal to an outer diameter of the inner rod 22, such that the inner carbon filter 42 and inner rod 22 are axially aligned and abut in an end-to-end relationship. The ends of the inner carbon filter 42 and the outer filter 44 are preferably open to permit the passage of air and smoke therethrough. In accordance with one embodiment the inner carbon filter 42 and the outer filter 44 extend from the upstream end 16 to the buccal (or mouth) end 18 of the filter 40.

The inner carbon filter 42 is preferably a carbonaceous material such as charcoal, carbon on tow, activated carbon or other adsorbent or catalyst materials. In accordance with one embodiment, the inner carbon filter 42 includes an impervious outer wrap 46. The impervious outer wrap 46 can be a paper plug wrap having an air permeability of 100 Coresta units or less, preferably 10 Coresta units or less and more preferably approximately 0 Coresta units. Alternatively, the impervious outer wrap 46 can be cellophane, polyvinyl acetate (PVA), polyvinylidene chloride, a thermoplastic film, such as polypropylene or polyethylene, aluminized paper, biodegradable plastic, or other impermeable material, which is suitable for use in cigarettes. In accordance with an alternative embodiment, at least a portion of an inner wall or surface 48 of the outer filter 44 can be coated with an impervious inner layer 49 of a suitable material for cigarette use as described above, such as polyvinyl acetate (PVA), which forms an impervious inner layer 49 on the inner wall or surface 48 of the outer filter 44.

The outer filter (filter shell) 44 can be a starch-based, polypropylene, or plasticized cellulose acetate tow, filter paper or other suitable material. The outer filter (or filter shell) 44 material also can have the form of a gathered web (e.g., polypropylene web, polyester web, cellulosic web or starch-based web). The outer filter 44 is preferably circumscribed by a paper plug wrap 52, which optionally may incorporate a carbonaceous material. The plug wrap 52 preferably circumscribes the entire length of the filter 40.

The filter 40 is attached to the tobacco rod 20 by a tipping paper 50, which circumscribes both the entire length of the filter 40 and an adjacent region of the tobacco rod 20. The tipping paper 50 is typically a paper-like product. However, any suitable material can be used.

In a preferred embodiment, during an initial puff or puffs, the outer filter (filter shell) 44 delivers a mainstream smoke that, at least in substantial part, has not contacted any activated carbon within the inner carbon filter 42 and is therefore without the taste deficits commonly associated with carbon-filter cigarettes. Specifically, the first puff (or initial puffs) of the smoking article 10 travels toward the filter 40 through the outer rod 24 because the inner rod 22 is impervious to flow, such that the mainstream smoke from the first puff is filtered through the cellulose acetate filter shell 44 only. Prior to the second puff (and/or subsequent puffs), the smolder of the smoking article 10 combusts the capped end 29 of the inner core 22, opening the inner core 22 to the flow of mainstream smoke. Thus, the second and/or subsequent puffs flow through the inner core 22 and into the activated or inner carbon filter 42 to achieve smoke constituent reduction.

Preferably at least some, if not all of the inner carbon filter 42 is flavor-bearing or otherwise impregnated with a flavorant so that the carbon is adapted not only to remove one or more gas phase smoke constituents from smoke, but also to release flavor into the mainstream smoke stream. In accordance with an embodiment, the flavorant is added to the inner carbon filter 42 by spraying flavorant upon a batch of activated carbon in a mixing (tumbling) drum or alternatively in a fluidized bed with nitrogen as the fluidizing agent, wherein flavorant may then be sprayed onto the carbon in the bed as described in U.S. Pat. No. 6,761,174 to Jupe et al., the entire content of which is incorporated herein by reference.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a tobacco rod comprising:

an inner rod of tobacco material, which is wrapped in an impervious tobacco sheet and an impervious end cap of reconstituted tobacco at an upstream end thereof; and an outer rod of tobacco material, wherein the inner rod of tobacco material is concentrically positioned with respect to the outer rod of tobacco material;

a filter attached to the tobacco rod, the filter comprising:

an outer filter; and an inner carbon filter, wherein the inner carbon filter is concentrically positioned with respect to the outer filter; and wherein the tobacco rod has an upstream end and a downstream end, and wherein the inner rod extends from the filter toward the lit end for about 75 to 95 percent of a length of the tobacco rod.

2. The smoking article of claim 1, wherein the inner carbon filter includes an outer wrap, and wherein the impervious outer wrap comprises a paper plug wrap having an air permeability of 0 Coresta units.

3. The smoking article of claim 1, wherein at least a portion of an inner surface of the outer filter is coated with a layer of polyvinyl acetate.

4. The smoking article of claim 1, wherein the impervious end cap on the inner rod is a tobacco sheet.

5. The smoking article of claim 1, wherein the inner carbon filter includes a flavorant.

6. The smoking article of claim 1, wherein the filter is attached to the tobacco rod by a tipping paper.

7. The smoking article of claim 1, wherein the impervious tobacco sheet wrapped around the inner rod of tobacco material and the impervious end cap of reconstituted tobacco have an air permeability of 0 Coresta units.

8. A smoking article comprising:

a tobacco rod comprising:

an inner rod of tobacco material, which is wrapped in an impervious tobacco sheet and an impervious end cap of reconstituted tobacco at an upstream end thereof; and an outer rod of tobacco material, wherein the inner rod of tobacco material is concentrically positioned with respect to the outer rod of tobacco material;

a filter attached to the tobacco rod, the filter comprising:

an outer filter; and an inner carbon filter, wherein the inner carbon filter is concentrically positioned with respect to the outer filter; and wherein the impervious tobacco sheet wrapped around the inner rod of tobacco material and the impervious end cap directs mainstream smoke from an initial puff or puffs to the outer filter, and wherein the impervious end cap is combustible upon exposure to the smolder of the smoking article, which opens the inner rod to a flow of mainstream smoke from the smoking article; and wherein the tobacco rod has an upstream end and a downstream end, and wherein the inner rod extends from the filter toward the lit end for about 75 to 95 percent of a length of the tobacco rod.

9. The smoking article of claim 8, wherein the flow of mainstream smoke from subsequent puffs is directed through the inner carbon filter.

10. The smoking article of claim 8, wherein the filter is attached to the tobacco rod by a tipping paper.

11. The smoking article of claim 8, wherein the impervious tobacco sheet wrapped around the inner rod of tobacco material and the impervious end cap of reconstituted tobacco have an air permeability of 0 Coresta units.

12. A smoking article comprising:

a tobacco rod comprising:

an inner rod of tobacco material, which is wrapped in an impervious tobacco sheet and an impervious end cap of reconstituted tobacco at an upstream end thereof; and an outer rod of tobacco material, wherein the inner rod of tobacco material is concentrically positioned with respect to the outer rod of tobacco material; and a filter attached to the tobacco rod, the filter comprising:

an outer cellulose acetate filter; and an inner activated carbon filter, wherein the inner activated carbon filter is concentrically positioned with respect to the outer cellulose acetate filter; and wherein the tobacco rod has an upstream end and a downstream end, and wherein the inner rod extends from the filter toward the lit end for about 75 to 95 percent of a length of the tobacco rod.

13. The smoking article of claim 12, wherein the activated carbon filter includes an outer wrap, and wherein the outer wrap comprises a paper plug wrap having an air permeability of 0 Coresta units.

14. The smoking article of claim 12, wherein at least a portion of an inner surface of the outer cellulose acetate filter is coated with a layer of polyvinyl acetate.

15. The smoking article of claim 12, wherein the impervious end cap on the inner rod is a tobacco sheet.

16. The smoking article of claim 12, wherein the impervious tobacco sheet wrapped around the inner rod of tobacco material and the impervious end cap directs mainstream smoke from an initial puff or puffs to the outer filter, and wherein the end cap is combustible upon exposure to the smolder of the smoking article, which opens the inner rod to a flow of mainstream smoke from the smoking article such that mainstream smoke from subsequent puffs is directed through the inner activated carbon filter.

17. The smoking article of claim 12, wherein the inner activated carbon filter includes a flavorant.

18. The smoking article of claim 12, wherein the filter is attached to the tobacco rod by a tipping paper.

19. The smoking article of claim 8, wherein the impervious tobacco sheet wrapped around the inner rod of tobacco material and the impervious end cap of reconstituted tobacco have an air permeability of 0 Coresta units.

* * * * *